US007892609B2

(12) United States Patent
Mueller

(10) Patent No.: US 7,892,609 B2
(45) Date of Patent: Feb. 22, 2011

(54) THERMAL SPRAYING APPARATUS AND ALSO A THERMAL SPRAYING PROCESS

(75) Inventor: Markus Mueller, Dintikon (CH)

(73) Assignee: Sulzer Metco AG, Wohlen (CH)

( * ) Notice: Subject to any disclaimer, the term of this patent is extended or adjusted under 35 U.S.C. 154(b) by 0 days.

(21) Appl. No.: 11/253,336

(22) Filed: Oct. 18, 2005

(65) Prior Publication Data

US 2006/0090699 A1 May 4, 2006

(30) Foreign Application Priority Data

Nov. 2, 2004 (EP) ..... 04405667

(51) Int. Cl.
*C23C 4/12* (2006.01)
*B05C 5/04* (2006.01)

(52) U.S. Cl. ..... 427/446; 427/449; 239/79; 239/80; 239/84; 239/85; 219/76.12; 219/76.16

(58) Field of Classification Search ..... 239/79, 239/80, 81, 83, 84, 85
See application file for complete search history.

(56) References Cited

U.S. PATENT DOCUMENTS 3,438,579 A * 4/1969 Wiese ..... 239/85
3,935,418 A * 1/1976 Stand et al. ..... 219/121.47
4,582,254 A * 4/1986 Rotolico et al. ..... 239/80
5,233,153 A * 8/1993 Coats ..... 219/121.47
5,362,523 A * 11/1994 Gorynin et al. ..... 427/446
6,478,234 B1 * 11/2002 Klein et al. ..... 239/80
2004/0146657 A1 * 7/2004 Heuser et al. ..... 427/446

FOREIGN PATENT DOCUMENTS

| | | | |
|---|---|---|---|
| JP | 05-179417 | * | 7/1993 |
| JP | 05179417 | | 7/1993 |
| JP | 09263927 | | 10/1997 |
| JP | 10068059 | | 3/1998 |
| JP | 10-152766 | * | 6/1998 |
| JP | 10152766 | | 6/1998 |
| JP | 2002231498 | | 8/2002 |

OTHER PUBLICATIONS

Translation of Japan 10-152766, publication date Jun. 9, 1998.*

* cited by examiner

*Primary Examiner*—Katherine A Bareford
(74) *Attorney, Agent, or Firm*—Kilpatrick Townsend & Stockton LLP

(57) ABSTRACT

The invention relates to a thermal spraying apparatus (1) for coating a surface (2) of a substrate (3) by means of a coating material (4). The thermal spraying apparatus (1) includes a spray pistol (5) with a heating device for heating the coating material (4) in a heating zone (6) and also a charging apparatus (7) with a feed (8) through which the coating material (4) can be introduced into the heating zone (6). In this arrangement the thermal spraying apparatus is so designed that a relative position (9) between the feed (8) and the heating zone (6) can be changed in the operating state.

12 Claims, 5 Drawing Sheets

THERMAL SPRAYING APPARATUS AND ALSO A THERMAL SPRAYING PROCESS

BACKGROUND OF THE INVENTION

The invention relates to a thermal spraying apparatus and also to a thermal spraying process for coating a substrate.

"Thermal spraying" has been established for a long time in the manufacture of single parts and in industrial series production. The most common thermal spraying processes which are in particular also used in series production for the coating of the surfaces of large numbers of substrates are, for example, flame spraying with a spray powder or with a spray wire, arc spraying, high velocity flame spraying (HVOF), detonation spraying or plasma spraying. The above-named list of thermal spraying processes is certainly not exhaustive. On the contrary, the person averagely skilled in the art is familiar with a large number of variations of the listed processes, and of further processes, for example special processes such as flame spray welding.

In this connection thermal spraying has opened up broad areas of use. One can certainly estimate that thermal spraying as a surface coating process is the coating technology with probably the largest area of use with regard to its possibilities of use. Thus a delimitation of the areas of use of the spraying processes listed above does not seem particularly sensible because the areas of use can overlap one another.

In this context the spectrum of use of the different thermal spraying processes ranges from the improvement of the performance of stressed surfaces against mechanical stresses, such as friction for example, against high temperatures, against chemical attacks on the surface to aesthetic use such as for example the improvement of the appearance of objects of personal use. The range of substrates whose surfaces are routinely coated by thermal spraying today is correspondingly broad. Typical examples are parts of all kinds which are subject to wear and tear, components of combustion engines such as the running surfaces of cylinders in petrol or diesel engines, pistons and piston rings of these engines, the application of heat insulation layers onto turbine parts of turbines for use on land or in the air, the coating of hydraulic pistons, kitchen utensils, such as pots or pans, and much more. All materials which can be melted or at least become viscous or melted at the surface by the supply of energy can be considered as spraying material in the form of spray powder or spray wires, for example. Practically all kinds of materials can be coated in this manner, for example wood, glass, ceramics, metals, steels and alloys, but also plastics and textiles.

Special applications very often demand the application of a coating which is constructed from a plurality of individual layers sprayed on top of one another. Thus, by way of example, a coating which is intended to protect a turbine blade against the extreme conditions in the turbine in the operating state can consist of a bond layer or a connecting layer, which guarantees a good connection to the substrate of a layer to be applied. An anti-diffusion layer can be applied on this which prevents a diffusion of alloy components out of the substrate or vice versa for example. A special hard layer can be provided as a further layer of the surface layer which protects against mechanical and chemical attacks in particular and finally a heat insulating layer can be applied as a covering layer, for example on the basis of zirconium oxide for protection against the high temperatures which prevail in the operating state of the turbine.

As the above-named example impressively shows, one of the great advantages of thermal spraying is that a coating can be applied from a layer system of a plurality of individual layers which can be sprayed from completely different materials and thus can also fulfill different functions. Furthermore it is also possible in special cases to combine different thermal spraying processes when applying a layer system, so that a specific layer of the layer system can be applied by means of a plasma spraying process, for example, and another layer of the same layer system, for example a final thermal insulating layer, is sprayed on by means of a HVOF process. It is even possible to combine a thermal spraying process with another coating process, for example with a thin layer process such as PVD (physical vapor deposition) or CVD (chemical vapor deposition) or with an arc vaporization process for example.

A typical example is the application of a dual-layer system with a plasma spraying process wherein the two layers have to be sprayed with two different spray powders. Thus it is known for example to apply a coating to a substrate as protection against wear which additionally has to satisfy certain aesthetic demands. The actual wear protection layer can have excellent wear protection characteristics, for example, and can also, for example, have a gleaming white color following the application, which is desired for aesthetic reasons. However, it can happen that the wear protection layer has very bad adhesive characteristics on the substrate to be coated. Therefore it is current practice, prior to the application of the for example white, aesthetically pleasing wear protection layer, to initially apply a bond layer made of another material directly to the surface of the substrate, i.e. using a different spray material than the spray powder from which the wear protection layer is formed. The spray powder for the bond layer is selected in such a way in this arrangement that, on the one hand, the spray powder has very good adhesive characteristics to the substrate and, on the other hand, so that the white wear protection layer adheres very well to the bond layer. As a result one has a coating comprised of a dual-layer system which as a whole adheres very well to the substrate and on the other hand offers a very good wear protection against mechanical attacks on the surface, with the coated surface simultaneously having an aesthetic white appearance.

A decisive disadvantage in the manufacture of these and other multiple layer systems, in particular in series production using the thermal spraying process known from the prior art and using the known thermal spraying apparatuses used for thermal spraying, is that the spraying procedure has to be interrupted during the coating process, at the transition from the spraying of one individual layer to the spraying of the next layer which has to be sprayed using a different spray material or using a different spraying process. This is because the spray pistol has to be exchanged, in order to change the type of spray pistol, and/or because another spray wire has to be installed. Depending on the specific thermal spraying apparatus or the specific thermal spraying process which is used, it can also be necessary to interrupt the spraying process to spray on a further layer, or to install the substrate in another thermal spraying apparatus, in order to then apply the further layer by means of the other thermal spraying apparatus.

The problems which were explained previously by way of example using the spraying process known from the prior art and the known thermal spraying apparatus lead to a considerable complication of the coating procedure as a whole. This requires additional equipment and results in the tying up of working resources, leading in particular to an increase in the working time during coating and thus to a clear cost increase for the corresponding products.

At least in some cases, i.e. in some quite special cases, namely in cases which relate to the thermal spraying of coatings made of a plurality of individual layers on the surface of a substrate by means of two or more different spray powders, attempts were made to avoid these problems by, for example, providing two or more different feeds in a plasma spraying apparatus which are associated with different powder supplies instead of a single feed for one spray powder.

In the above-named plasma spray apparatus, a plasma beam is produced by means of a plasma spray pistol, into which a spray powder is introduced by means of the feed, which is, for example, melted in the plasma flame of the plasma beam and is thrown onto the surface of a substrate which is to be coated, so that a surface layer made of the material of the spray powder forms on the substrate.

If now, by way of example, two feeds are provided for the spray powder, which can be fed with spray powder from two different spray powder supplies, then it is possible in this way to apply two (or more) different layers one after the other onto the surface of a substrate and thus to form a coating of a multiple layer system without changing the spraying process. A corresponding known thermal spraying process can for example be carried out in the following manner. A shutoff device is provided between the spray powder supplies, in which a certain spray powder is stored for supplying the feeds with spray powder, and the corresponding feed itself, so that the supply of the feed with spray powder can either be enabled or prevented.

To illustrate the process, reference will be made in the following to the dual-layer system already mentioned above, which comprises a bond layer which for example has a black color due to the spray powder used and a wear protection layer applied to this which should have a gleaming white color for aesthetic reasons.

For the application of this dual-layer system by means of a plasma spraying apparatus, a plasma flame is ignited initially in a spray pistol which is directed towards the substrate which is to be coated, so that spray powder which has been introduced into the plasma flame and sintered by the plasma flame is thrown onto the surface of the substrate to form a layer.

For the formation of the dual-layer system, the connection between the spray powder supply which contains the spray powder for the formation of the white wear protection layer is first interrupted so that no spray powder for the formation of the wear protection layer can be supplied to the corresponding feed. However the connection between the feed and the powder supply which contains the spray powder for formation of the bond layer is open, so that the powder for the formation of the bond layer can be supplied to the plasma flame.

By this means in a first process step, the bond layer can initially be applied to the substrate. When the application of the bond layer is complete the feeding of the spray powder to the feed from the spray powder supply is discontinued, so that no further spray powder can any longer be supplied to the corresponding feed from this powder supply.

Thereafter the connection is established between the feed which is associated with the powder supply which contains the spray powder for the formation of the white wear protection layer and the powder supply so that the spray powder for the formation of the white wear protection layer is supplied to the plasma flame and correspondingly the white wear protection layer can be applied on the previously applied black bond layer. Thus it is indeed possible using this apparatus known from the prior art to spray a dual- or multi-layer system using different spray powders, without interrupting the spraying process, i.e. without switching off the plasma flame and/or exchanging a feed for the spray powder and/or installing the substrate into another plasma spraying apparatus for the formation of a second layer.

A considerable disadvantage of this known plasma spraying apparatus is however that in a spray powder feed itself or in a connection line between a spray powder supply and the feed even after an interruption of the connection between the spray powder supply and the associated feed the remains of the corresponding spray powder still exist. The result of this is that by means of the considerable negative pressure which the plasma flame produces, these remnants of the spray powder are sucked out of the feed during further spraying together with another spray powder which is supplied to the plasma flame as described above from another feed for the spraying of a further layer, and thus the spray powder, which is actually intended for the formation of a further layer, is contaminated. This means that the further layer contains certain constituents of the spray powder which were actually intended solely for the formation of a first layer.

It is obvious that pollutants such as these can have considerable negative consequences. If for example pollutants are introduced into the white wear protection layer described above by that powder which should actually only form the black bond layer, the white covering layer will not have the lovely aesthetic white color but rather be dyed more or less grey or contain black spots. If aesthetic qualities play a certain role in a product, then a product with a surface which has been polluted in this manner is of course unusable and has to be rejected.

However pollutants in a layer can also lead to a clear deterioration of the mechanical, chemical, physical or thermal characteristics of the polluted layer. Even small amounts of pollutants can, in special cases, lead to certain layer characteristics deteriorating so dramatically that the coating as a whole no longer has the desired characteristics and the coated part is unusable and has to be rejected.

SUMMARY OF THE INVENTION

It is an object of the present invention to make available an improved thermal spraying apparatus and also an improved thermal spraying process using multiple layer systems which can be applied to a substrate, with the disadvantages known from the prior art being overcome.

The invention thus relates to a thermal spraying apparatus for coating a surface of a substrate by means of a coating material. The thermal spraying apparatus includes a spray pistol with a heating device for heating up the coating material in a heating zone and also a charging apparatus with a feed through which the coating material can be introduced into the heating zone. In this arrangement the thermal spraying apparatus is designed in such a manner that a relative position between the feed and the heating zone can be altered in the operating state.

Due to the fact that the relative position can be altered in the operating state between the feed and the heating zone, in which a spray powder which has been brought via a feed can be heated, a feed can be removed from the range of influence of the plasma flame when it is no longer needed for the supply of a spray powder in a second coating procedure following a first coating procedure, so that powder can no longer be sucked out of the no longer needed feed due to the suction action of the plasma flame. Thus, for example, a subsequent layer which may have to be sprayed with another spray powder can no longer be polluted by the powder which was used to spray the previous layer.

Thus, multi-layer systems made of different materials can be applied to a substrate in a particularly simple and efficient manner, without the spraying procedure having to be interrupted during the change from spraying a first layer of a layer system to be applied to the spraying of a further layer using a different spray powder in such a way that a feed for the spray powder is changed and/or that the substrate for applying a further layer onto a first sprayed layer has to be installed into another spraying apparatus.

In a preferred embodiment of a thermal spraying apparatus, the heating device of the thermal spraying apparatus is a plasma burner and/or a heating device for flame spraying and/or a heating device for detonation spraying and/or another thermal heat source. This means that the thermal spraying apparatus in accordance with the invention which is to be explained in the following can essentially be carried out using all known thermal spraying processes; i.e. the type of heating device and thus the type of the spraying pistol which a thermal spraying apparatus in accordance with the invention includes can be any of the spraying pistols or heating devices known from the prior art. Thus the spraying apparatus in accordance with the invention or the process in accordance with the invention can be employed universally and is suitable for applying practically any conceivable thermal coating using any desired spraying material, no matter whether spraying powder or spraying wire or a spraying material in a different form is applied onto a substrate, which can be made of any kind of material at all.

In an embodiment which is particularly important for industrial practice, the thermal spraying apparatus is designed in such a way in this arrangement that the feed is arranged to be movable in relation to the heating device. This can, for example, be realized in that the spray pistol itself has a position in relation to the spraying apparatus per se which cannot be altered in the operating state, whereas a position of the feed in relation to the heating zone, in other words for example in relation to the position to the plasma flame of a plasma spraying pistol, can be altered. For this purpose, in a special embodiment, the feed can, for example, be mounted on a movable carriage which is displaceable in relation to the heating zone which is, for example, defined by the plasma flame of a plasma spray pistol.

Preferably but not necessarily, as will be explained later on with a special example, at least a first feed and a second feed are provided, with at least the first feed, in a special case the first and second feeds, being arranged to be movable in relation to the heating device. In this arrangement a first coating material can be fed via the first feed and a second coating material can be fed via the second feed. An arrangement such as this allows the spraying of two or more different layers of a coating system using two or more different spray powders one after the other onto a substrate in a very efficient manner, without having to interrupt the spraying procedure as a whole and without resulting in a mixing or contamination of the different spray powders. Thus with the first feed, a first spray powder can be transported into the heating zone for spraying a first layer. When the first layer is finished, the first feed can be moved away from the range of influence of the heating zone and a second, different spray powder, for spraying a second layer onto the first layer, can be introduced into the heating zone via the second feed, without fear of a contamination of the second spray powder with the first spray powder. It is also conceivable that the second feed is only moved into the range of influence of the heating zone after the first feed has been removed from the range of influence of the heating zone. Different variants can be preferred depending on the spraying procedure used or the demands on the layer to be sprayed or the design of the coating processes as a whole and the nature of the actual spraying apparatus used.

In a further special embodiment of a thermal spraying apparatus in accordance with the invention, the heating device is movably arranged in relation to the feed. This means that as an alternative to the embodiment explained previously it is, for example, also possible for two different feeds to be present, which are, for example, connected to two different spray powder stores for the delivery of spray powder, with the position of the two feeds in relation to the thermal spraying apparatus as such being fixed in the operating state. In this case the spray pistol is movably arranged in relation to its position to the two feeds. The spray pistol can be arranged on a movable carrier for example, so that the spray pistol is arranged in relation to the first feed for spraying in such a way that a first spray powder can be introduced into the heating zone via the first feed and the spray pistol is displaced by movement of the movable carrier in such a way that spray powder from the second feed can be introduced into the heating zone, while the first feed is no longer located in the range of influence of the heating zone. In an apparatus such as this it is possible to spray two different layers onto a substrate next to each other without interrupting the spraying procedure per se. In a preferred variant of the embodiment explained above, the substrate is moved in synchronism with the spray pistol, by suitable coupling to the displacement of the spray pistol, so that two layers can also be sprayed one on top of the other.

It is also possible, in another embodiment of a thermal spraying apparatus in accordance with the invention, for at least one second heating device to be provided in addition to a first heating device and for at least the first heating device to be movably arranged in relation to one feed, and preferably for both to be movable in relation to one feed. In this way it is possible to apply different layers to one substrate using different types of spray pistols and/or using different spray powders.

In particular, for example, in an apparatus in accordance with the invention, when a substrate is to be provided with different layers alternately using a spray pistol for flame spraying or for HVOF spraying and a plasma spray pistol, a layer can first be applied by means of flame spraying and a second layer can be applied by means of plasma spraying. Since in the known apparatuses for flame spraying or for HVOF spraying the powder feed takes place as a rule axially via the feed and not radially from the outside, the feeds are, for example, swung out of the range of influence of the heating zone during the coating step by means of flame spraying, since the feeds are not required during flame spraying. When the coating step by means of flame spraying is complete, the spray pistol for flame spraying is exchanged for a plasma spray pistol and the feed for conducting the spray powder into the melting zone is swung correspondingly in the direction of the melting zone, which is produced by the plasma spray pistol. A cleaning unit can be further provided so that, if necessary, a feed for the spray powder can be moved out of the range of influence of the heating zone so that the feed can be cleaned by the cleaning unit, as is sufficiently familiar to the person averagely skilled in the art, so that the feed is again put into an ideal condition for a subsequent coating procedure.

It goes without saying from the above explanations that either the feed and/or the heating device and/or the cleaning unit are jointly movably arranged by means of a drive or are respectively individually linearly movably arranged relative to one another.

In this arrangement the relative movement of the previously named components of a thermal spraying apparatus in accordance with the invention does not have to be a linear movement. Depending on the circumstances or the special requirements placed on the spraying conditions, the path of the relative movement towards one another can also be more complicated than simply linear. Thus the feed and/or the heating device and/or the cleaning unit can, for example, be rotatably arranged relative to each other by means of a drive, which can be of advantage in particular when during a spraying procedure changes should be made between more than two different spray powders, and/or when changes should be made between more than two different types of spray pistol.

In this arrangement the drive for producing the relative movement can be a pneumatic drive and/or a hydraulic drive and/or a magnetic drive and/or an electrical drive, in particular a linear motor or a rotary machine or of any other kind.

The invention further relates to a thermal spraying process to be carried out in one of the thermal spraying apparatuses described above, with a surface of a substrate being coated with a coating material by means of a thermal spraying apparatus, including a spray pistol with a heating device and a charging apparatus with a feed, with the coating material being introduced via the feed into the heating zone and being heated in the heating zone by the heating device and with the relative position between the feed and the heating device being changed in the operating state.

The invention will be explained in more detail with the help of the drawings.

DESCRIPTION OF THE PREFERRED EMBODIMENTS

Figure 1:
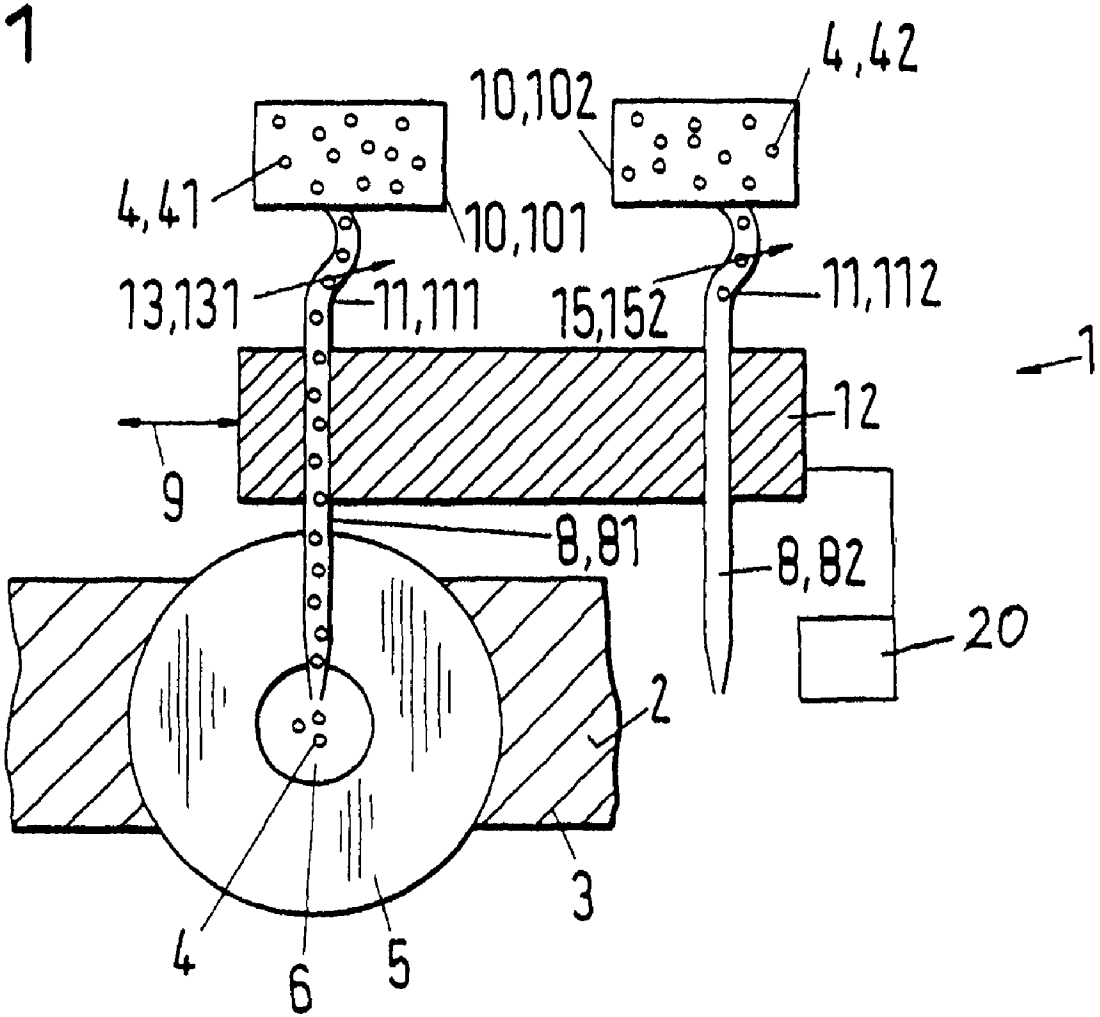
FIG. 1 shows an embodiment of a thermal apparatus made in accordance with the invention with a movably arranged feed.

Before a few embodiments of thermal spraying apparatuses in accordance with the invention are explained further with the help of the drawings, a typical arrangement of a thermal spraying apparatus 1' known from the prior art will be explained with reference to FIG. 1*a* as briefly as possible for the sake of clarity. The features known from the prior art are characterized in this arrangement by reference numerals with dashes.

Figure 1A:
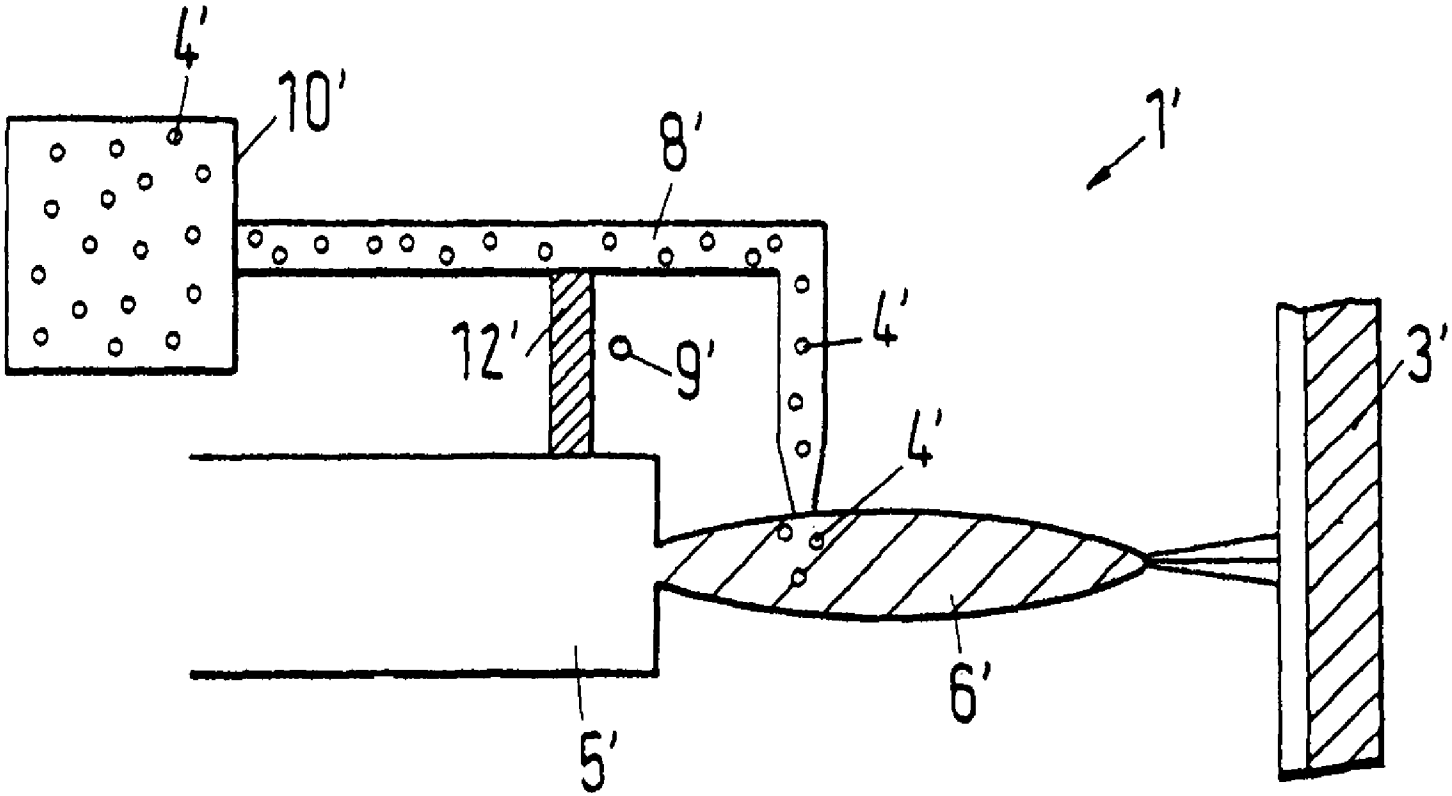
Fig.1a (PRIOR ART)
FIG. 1*a* shows a thermal spraying apparatus known from the prior art.

A typical known thermal spraying apparatus 1' includes, as illustrated schematically in FIG. 1*a*, essentially a spray pistol 5', which has a heating device, for example a plasma burner, which makes available a plasma flame in the region of a heating zone 6'. A feed 8' is fixed to the spray pistol 5' by means of a powder injector holder 12', the feed 8' being connected to a powder supply 10', which contains coating material 4', for example spray powder 4', which can be conducted to the heating zone 6' by means of the feed 8', so that the coating material 4' can be heated in the heating zone 6' and then can be applied to the substrate 3' for the formation of a layer. Characteristic for the known thermal spraying apparatus 1' in this arrangement is that the relative position 9' between the feed 8' and the heating zone 6' remains unaltered, at least during a complete spraying procedure which is symbolized by the point with the reference numeral 9'.

FIGS. 1-4 explained in the following correspond from the point of view of the type of illustration to a vertical section in accordance with the type of illustration of FIG. 1*a*. However FIGS. 1-4 are illustrations of thermal spraying apparatuses in accordance with the invention and do not represent the prior art like FIG. 1*a*.

FIG. 1 shows, in schematic illustration, a thermal spraying apparatus in accordance with the invention which will be given the reference numeral 1 in the following.

This embodiment, which is particularly important in practice, is particularly suitable, for example, to spray on a coating made of two layers using two different spray powders 4, 41, 42 onto a surface 2 of a substrate 3 one after another and one over the other. In the arrangement illustrated in FIG. 1 the substrate 3 is coated in turn with a spray powder 41 and a spray powder 42 for the formation of a two-layer system.

Two containers 10, a first container 101 and a second container 102, are provided as spray powder supplies 10, 101, 102, which contain two different spray powders 4, a first spray powder 41 and a second spray powder 42, for spraying two different layers. The container 101 is connected to the first feed 81 via a first lead 111, so that the first spray powder 41 can be brought into a heating zone 6 via the first feed 81. Analogue to this the second feed 82 is connected to the second container 102 via the second lead 112 so that when the second feed 82 is located in the region of the heating zone 6, the second spray powder 42 can be brought into the heating zone for spraying a second layer. A cut-off valve 131, 152 is respectively provided in the leads 111, 112 so that the powder supply from the containers 41, 42 to the corresponding feeds 81, 82 can either be stopped by closing of the cut-off valve 131, 152 or can be made possible by opening of one of the cut-off valves 131, 152. The two cut-off valves 81, 82 are provided together on a movable rail which will be referred to generally in the following as the powder injector holder 12. The fact that the powder injector holder 12 is displaceable is shown symbolically by the double arrow 9. As shown in FIG. 1, the substrate 3 is coated with a first layer using the spray powder 41. When the coating procedure, i.e. the coating with the spray powder 41, has been completed, the powder injector holder is displaced towards the left-hand side along the double arrow 9 in accordance with the drawing, by means of a drive not shown in FIG. 1, until the feed 82 is positioned in such a way that spray powder 42 can be brought into the melting zone 6 by means of the feed 82. Thus a second layer can then be sprayed onto the first layer which was sprayed on with the spray powder 41 without fear of a pollution of the second spray powder 42 by the first spray powder 41. While one of the layers is sprayed onto the substrate, a cleaning unit 20 can be used to clean the feed that is positioned away from heating zone 6.

Figure 2:
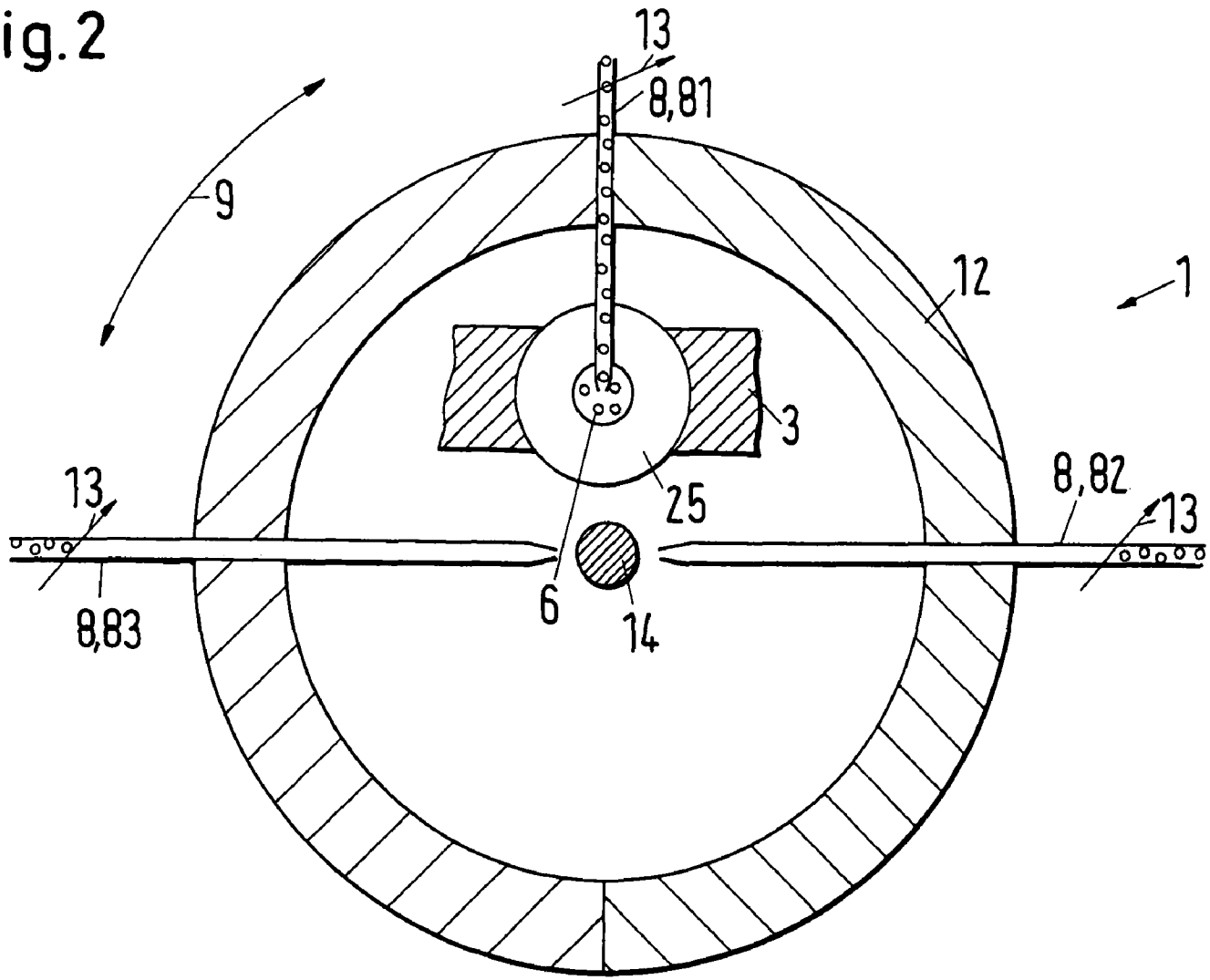
FIG. 2 shows a different embodiment in accordance with FIG. 1 with rotatably arranged feeds.

Another embodiment in accordance with FIG. 1 with rotatably arranged feeds is illustrated schematically in FIG. 2.

In the embodiment illustrated here, three different feeds 8, namely a first feed 81, a second feed 82 and a third feed 83, are provided which are arranged on a powder injector holder 12 which is essentially formed as a circular ring. The substrate 3 can be coated with at least three different layers one after the other by means of the thermal spraying apparatus 1 shown in FIG. 2. It is of course possible, without any problems, to provide more or less than three feeds 8 on the circular powder injector. This also applies to the powder injector holder 12 in accordance with FIG. 1 in just the same way. In principle the coating procedure functions with the thermal spraying apparatus 1 in accordance with FIG. 2 analogously to that as already explained at length in the description of FIG. 1. The essential difference is to be found in the fact that the changing from one feed 8, for example of the first feed 81, to another feed 82 or 83 takes place by means of a rotary movement of the powder injector holder 12 about a rotational axis 14, as symbolized by the double arrow 9, and not by means of a linear movement as in the powder injector holder in accordance with FIG. 1.

Figure 3:
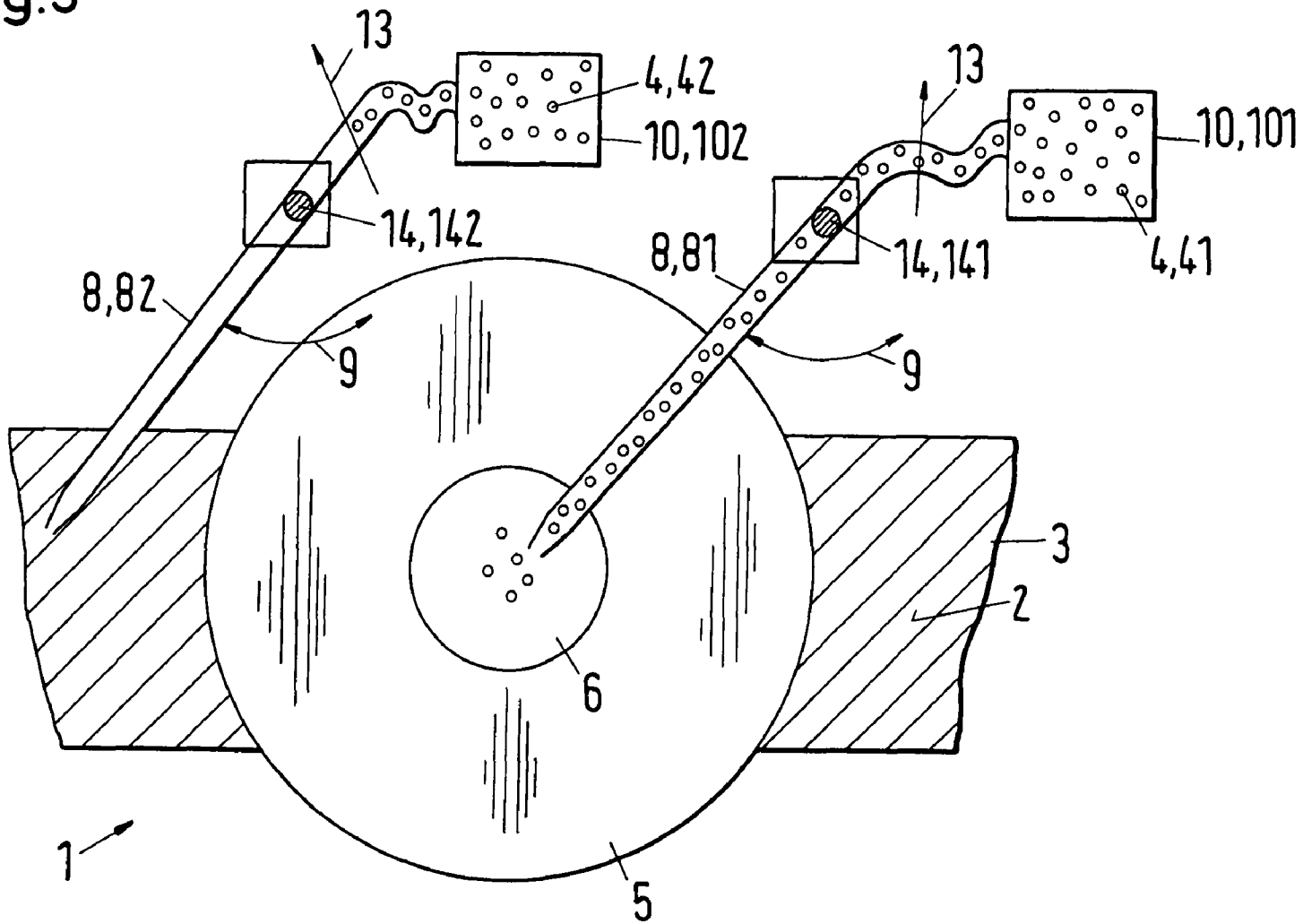
FIG. 3 shows a third embodiment with pivotably arranged feeds.

A third embodiment with pivotably arranged feeds is illustrated in FIG. 3. This spraying apparatus 1 is also suitable for coating the substrate 3 with two different spray powders 41, 42 one after the other. The essential difference is merely that the changing of the feeds 81, 82 takes place due to the fact that the feeds 81, 82 can be pivoted, preferably simultaneously, about respective pivot axes 14, as is shown symbolically by the double arrow 9. This means that, for example when a first layer has been sprayed with a spray powder 41 from the container 101 onto the surface 2 of the substrate 3, the feed 81 is swivelled away out of the range of the heating zone 6 to the left-hand side about the axis 141 in accordance with the drawing and the feed 82 is swivelled about the axis 142 into the range of the heating zone 6. The valves 13 which regulate the supply of the spray powder 41, 42 are opened or closed, precisely as has already been described above for the two other embodiments.

Figure 4:
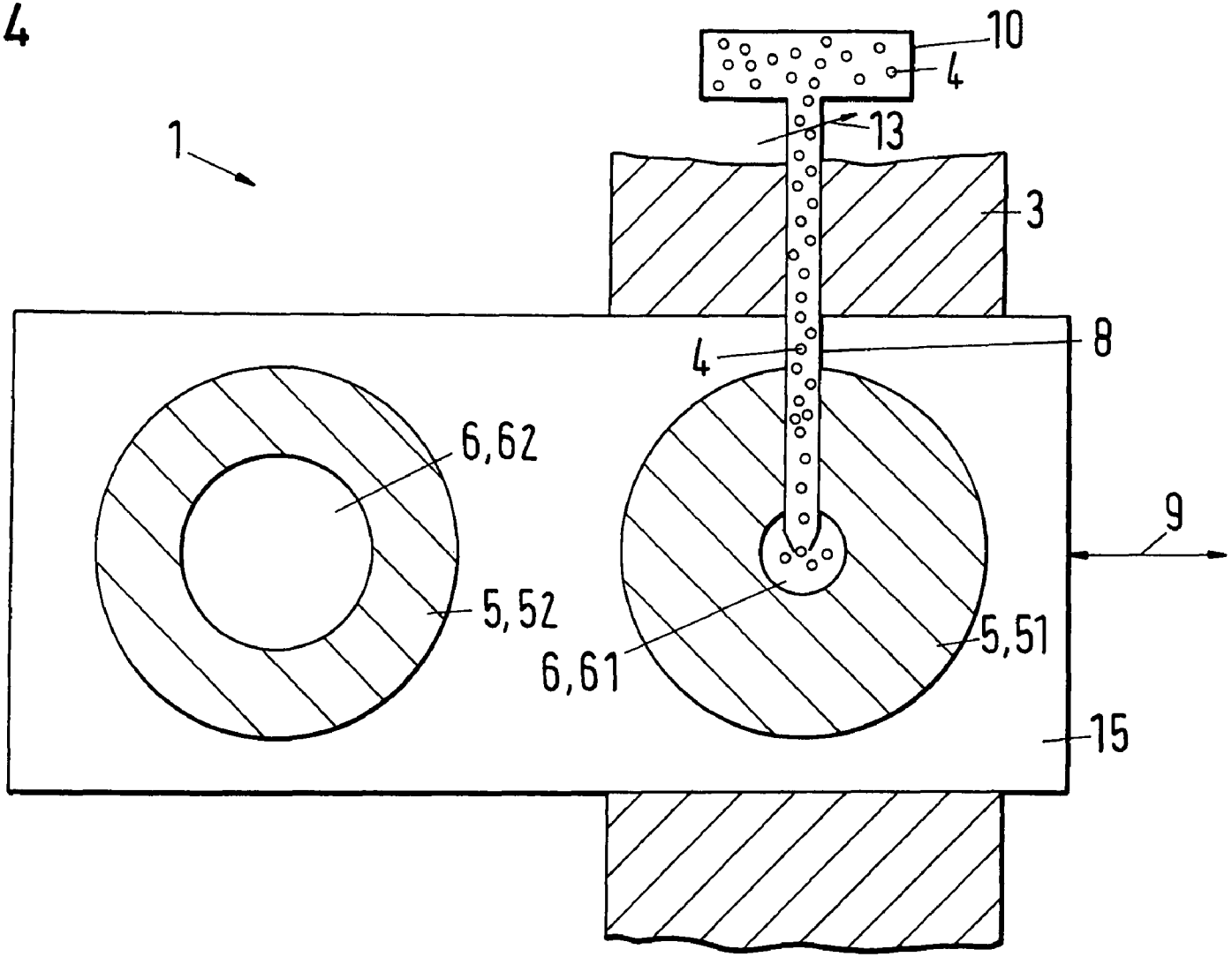
FIG. 4 shows an embodiment with a movably arranged spray pistol.

Finally an embodiment of a spraying apparatus 1 in accordance with the invention with movably arranged spray pistols 5, 51, 52 is shown in FIG. 4. This special embodiment is particularly suitable when, for example, two layers are to be applied using one and the same spray powder with two different spray pistols. It is well known that layers with different characteristics can be sprayed using one and the same spray powder by using different spray pistols which work with different spraying parameters or according to different processes. Thus the spray pistol 51 shown schematically in FIG. 4 can be a Sulzer Metco F4-MB plasma spray gun for example while the spray pistol 52 is a Sulzer Metco Triplex II plasma spray gun. Layers of considerably higher quality can be sprayed using the latter for example, so that an optimum surface is achieved while a bond layer is, for example, sprayed on using the F4-MB plasma spray gun, for which fewer demands are made with regard to its surface, since this is subsequently covered by the very high quality layer, sprayed with the Triplex spray pistol 52. Whereas the two above-named types of spray pistol 5 are both plasma spray pistols 5, the two spray pistols 51, 52 could also be two spray pistols which work according to different principles. Thus for example the spray pistol 51 can be a flame spray pistol or a wire spray pistol 52. It goes without saying that any other combination of types of spray pistols 5 is also possible.

In the embodiment shown in FIG. 4, in contrast to the embodiments explained with the help of FIGS. 1-3, a substrate 3 which is to be coated is positioned in front of a feed 8, with a first spray pistol 51 being exchangeable for a second spray pistol 52 during a spraying procedure.

Here the two spray pistols 51, 52 are mounted on a movable spray pistol holder 15 which can be displaced during the spraying procedure in the direction of the double arrow 9 to change the spray pistols, so that one after the other, a layer can be sprayed on first, using the spray pistol 51 and after this a second layer can be sprayed on using the spray pistol 52. It goes without saying that analogously to the embodiments in accordance with FIG. 2 and FIG. 3, the spray pistols 51, 52 can also be mounted on an annular spray pistol holder 15, or that the spray pistols 51, 52 can also be arranged to be pivotable. Of course more than two of the same or different spray pistols can also be provided on a spray pistol holder 15 in order to be able to spray more than two different layers onto a substrate 3.

It is clear that the embodiments which have been explained in more detail above can also be combined in any suitable manner. This means that thermal spraying apparatuses 1 are in particular possible in which a plurality of the same or different types of spray pistols 5 can be provided, as well as one or more different feeds 8, which are movable relative to one another separately or jointly, so that layer systems can be sprayed from different spray powders and/or according to different spraying processes such as, for example, plasma spraying, wire spraying, HVOF, etc.

The invention claimed is:

1. A plasma spraying method for coating a surface of a substrate with a coating material in a spray procedure comprising providing a spray pistol with a plasma burner heating device for heating the coating material in a heating zone, where the coating material passes from the heating zone to the substrate to provide a coating, providing first and second conduits containing the coating material through which the coating material is introduced into the heating zone, the first and second conduits being attached in a fixed position to a holder that is movable relative to the heating zone between two different first and second positions, so that in the first position the first conduit directs coating material from the first conduit into the heating zone to provide a first coating layer on the substrate surface and the second conduit is sufficiently away from the heating zone to prevent a vacuum in the heating zone from sucking coating material in the second conduit into the heating zone and to prevent coating material from the second conduit from entering the heating zone, and in the second position the second conduit directs coating material from the second conduit into the heating zone to provide a second coating layer on the substrate surface and the first conduit is sufficiently away from the heating zone to prevent a vacuum in the heating zone from sucking material in the first conduit into the heating zone and to prevent coating material from the first conduit from entering the heating zone, and moving the holder to the first position, and while the holder is in the first position, flowing coating material through the first conduit into the heating zone, and passing this coating material from the heating zone onto the substrate to form a first coating layer on the surface of the substrate, and simultaneously preventing material in the second conduit from entering the heating zone, and then moving the holder to the second position and, while the holder is in the second position, flowing coating material through the second conduit into the heating zone, and passing this coating material from the heating zone onto the substrate to form a second coating layer on the surface of the substrate, and simultaneously preventing material in the first conduit from entering the heating zone, so that the first and second coating layers are applied to the substrate surface without interrupting the spraying procedure and without causing cross-contamination of coating materials from the respective conduits in the heating zone.

2. A method according to claim 1 wherein the coating material in the first and second conduits comprises different coating materials.

3. A method according to claim 1 wherein moving the holder and the first and second conduits attached in a fixed position thereto comprises moving the holder linearly.

4. A method according to claim 1 wherein moving the holder and the first and second conduits attached in a fixed position thereto comprises rotating the holder about an axis.

5. A plasma spraying apparatus for coating a surface of a substrate with a coating material in a spraying procedure, comprising a spray pistol with a plasma burner heating device for heating the coating material in a heating zone, where the coating material passes from the heating zone to the surface of the substrate to provide a coating, first and second conduits through which the coating material can be introduced into the heating zone, the first and second conduits being attached in a fixed position to a holder that is movable relative to the heating zone between two different first and second positions, so that the first position the first conduit directs coating material from the first conduit into the heating zone to provide a first coating layer on the substrate surface and the second conduit is sufficiently away from the heating zone to prevent a vacuum in the heating zone from sucking coating material in the second conduit into the heating zone and to prevent coating material from the second conduit from entering the heating zone, and in the second position the second conduit directs coating material from the second conduit into the heating zone to provide a second coating layer on the substrate surface and the first conduit is sufficiently away from the heating zone to prevent a vacuum in the heating zone from sucking coating material in the first conduit into the heating zone and to prevent coating material from the first conduit from entering the heating zone, and allowing movement between the first and second positions by the holder, thereby allowing the first and second coating layers to be applied to the substrate surface without interrupting the spraying procedure and without causing cross-contamination of coating materials from the respective conduits in the heating zone.

6. A plasma spraying apparatus in accordance with claim 5, wherein the coating material is present as spray powder and/or as spraying wire.

7. A plasma spraying apparatus in accordance with claim 5, wherein a first coating material can be supplied via the first conduit and a second, different coating material can be supplied via the second conduit.

8. A plasma spraying apparatus in accordance with claim 5, wherein at least a first heating device for the first heating zone and a second heating device for a second heating zone are provided and the spraying apparatus is designed in such a way that at least the first heating zone is movably arranged relative to the conduits.

9. A plasma spraying apparatus in accordance with claim 5, including a cleaning unit adapted to clean the conduits outside a range of influence of the heating zone.

10. A plasma spraying apparatus in accordance with claim 9, wherein the holder to which the first and second conduits are attached in a fixed position and/or the heating zone and/or the cleaning unit are linearly movable relative to each other by means of a drive.

11. A plasma spraying apparatus in accordance with claim 9, wherein the holder to which the first and second conduits are attached in a fixed position and/or the heating zone and/or the cleaning unit are rotatably movable relative to one another by means of a drive.

12. A plasma spraying apparatus in accordance with claim 10, wherein the drive is a pneumatic drive and/or a hydraulic drive and/or a magnetic drive and/or an electrical drive.

* * * * *